US008604392B1

(12) United States Patent
Ostrom et al.

(10) Patent No.: US 8,604,392 B1
(45) Date of Patent: Dec. 10, 2013

(54) HYDRATION SYSTEMS AND METHODS

(75) Inventors: Robert E. Ostrom, Anchorage, AK (US); Billy Koitzsch, Anchorage, AK (US)

(73) Assignee: Arctic Innovations, Anchorage, AK (US)

( * ) Notice: Subject to any disclaimer, the term of this patent is extended or adjusted under 35 U.S.C. 154(b) by 244 days.

(21) Appl. No.: 12/944,603

(22) Filed: Nov. 11, 2010

Related U.S. Application Data

(60) Provisional application No. 61/311,095, filed on Mar. 5, 2010.

(51) Int. Cl.
*H05B 3/02* (2006.01)

(52) U.S. Cl.
USPC ..... 219/214; 219/523; 219/538; 392/398; 392/472

(58) Field of Classification Search
CPC ..... H05B 3/02; H05B 1/02
USPC ..... 392/472, 485, 489, 398; 219/537, 539, 219/523, 536, 541, 214
See application file for complete search history.

(56) References Cited

U.S. PATENT DOCUMENTS

| | | | | | |
|---|---|---|---|---|---|
| 2,285,776 | A | * | 6/1942 | MacCoy | 392/443 |
| 4,423,311 | A | * | 12/1983 | Varney, Sr. | 392/468 |
| 5,060,833 | A | * | 10/1991 | Edison et al. | 224/148.2 |
| 5,859,953 | A | * | 1/1999 | Nickless | 392/489 |
| 6,039,305 | A | * | 3/2000 | Hoskins et al. | 251/342 |
| 6,085,947 | A | * | 7/2000 | Lien | 222/525 |
| 6,722,533 | B2 | | 4/2004 | Skillern | |
| 2002/0113101 | A1 | | 8/2002 | Skillern | |
| 2004/0238570 | A1 | | 12/2004 | Skillern | |
| 2006/0151534 | A1 | | 7/2006 | Mares | |
| 2007/0084844 | A1 | | 4/2007 | Woodfill et al. | |
| 2009/0095773 | A1 | | 4/2009 | Pinne | |
| 2010/0186844 | A1 | * | 7/2010 | Koskey, Jr. | 138/33 |

* cited by examiner

*Primary Examiner* — Mark Paschall
(74) *Attorney, Agent, or Firm* — Woods Patent Law

(57) ABSTRACT

A hydration system comprises a bladder assembly defining a bladder chamber, a hose assembly, and a heating system comprising a heating element defining a loop portion. Liquids flow from the bladder chamber to the hose assembly. The loop portion is arranged within the hose assembly such that current flowing through the heating element inhibits freezing of liquids within at least a portion of the hose assembly.

20 Claims, 6 Drawing Sheets

HYDRATION SYSTEMS AND METHODS

RELATED APPLICATIONS

This application claims benefit of priority to U.S. Provisional Application Ser. No. 61/311,095, filed Mar. 5, 2010.

The contents of all related applications are incorporated herein by reference.

TECHNICAL FIELD

The present invention relates to hydration systems and, more particularly, hydration systems that are carried or worn by a user in cold climates.

BACKGROUND

Hydration or drinking systems adapted to be worn or carried by the user typically comprise a bladder supported by a backpack or the like, a bite valve, and a hose extending from the bladder to a bite valve such that the bite valve can be arranged adjacent to the user's mouth. When thirsty, the user takes the bite valve in his or her mouth, bites to open the valve, and sucks to draw fluid, typically water, from the bladder. Such hydration systems can be used in a substantially hands-free manner.

Hydration systems can be used in both summer and in winter. A typical hydration bladder rarely freezes during winter use because it is generally kept near the body. However, under severe conditions, the drinking hose and bite valve can and do freeze, sometimes quickly, when used in the winter.

SUMMARY

The present invention may be embodied as a hydration system comprising a bladder assembly defining a bladder chamber, a hose assembly, and a heating system comprising a heating element defining a loop portion. Liquids flow from the bladder chamber to the hose assembly. The loop portion is arranged within the hose assembly such that current flowing through the heating element inhibits freezing of liquids within at least a portion of the hose assembly.

The present invention may also be embodied as a method of inhibiting freezing of liquid in a hydration system comprising a bladder assembly defining a bladder chamber and a hose assembly comprising the following steps. A heating element is provided. The heating element is inserted from the bladder chamber into the hose assembly such that the heating element defines a loop portion within the hose assembly. Current is caused to flow through the heating element such that heat radiating from the heating element is transferred to the fluids within at least a portion of the hose assembly.

The present invention may also be embodied as a hydration system comprising a bladder assembly comprising a bladder defining a bladder chamber, a hose assembly comprising a hose and a bite valve member defining a valve chamber, and a heating system comprising a heating element defining a loop portion. Liquids flow from the bladder chamber to the valve chamber. The loop portion is arranged within the valve chamber such that current flowing through the heating element generates heat that inhibits freezing of liquids within at least a portion of the hose assembly.

DETAILED DESCRIPTION

Figure 1:
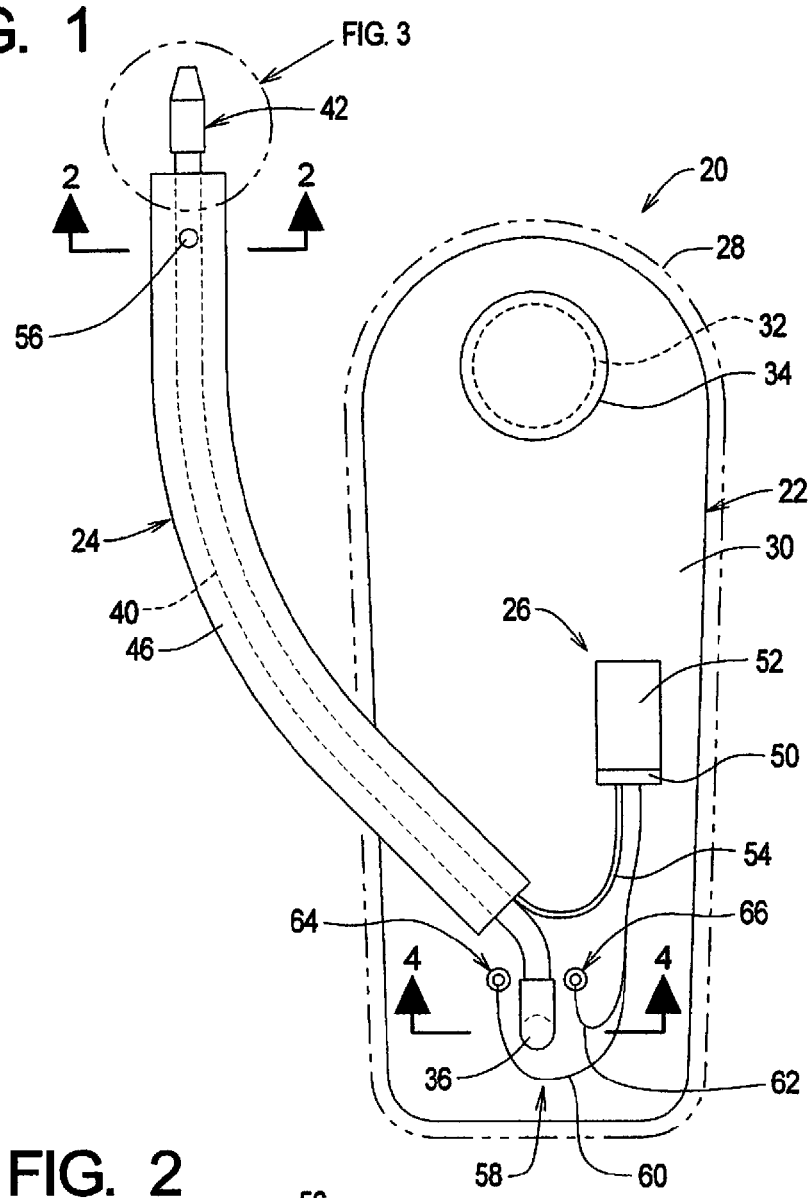
FIG. 1 is a somewhat schematic rear elevation view of a hydration system employing a first example heating system of the present invention.

Referring initially to FIGS. 1-4 of the drawing, depicted therein is a first example hydration system 20 constructed in accordance with, and embodying, the principles of the present invention. The first example hydration system 20 comprises a bladder assembly 22, a hose assembly 24, a heating system 26, and a carrying assembly 28.

In general, the bladder assembly 22 contains water or other drinkable liquids, and the hose assembly 24 allows a user to drink liquids from the bladder assembly in a conventional manner. The example heating system 26 is arranged to extend through and heat the hose assembly 24 to prevent freezing of liquids contained by the hose assembly 24 without interfering with the user's ability to drink fluids from the bladder assembly 22 through the hose assembly 24. The carrying assembly 28 is optional and facilitates carrying or wearing of the bladder assembly 22, hose assembly 24, and/or heating system 26.

The bladder assembly 22 comprises a bladder 30 defining a bladder chamber 32, a bladder cap 34, and a bladder outlet 36. The bladder cap 34 may be detachably attached to the bladder 30 to prevent or allow access to the bladder chamber 32 in a conventional manner.

The hose assembly 24 comprises a hose member 40, a bite valve member 42 defining a valve chamber 44, and an insulation member 46. The hose member 40 is operatively connected to the bladder outlet 36 and the bite valve 42 such that a fluid path is defined between the bladder chamber 32 and the valve chamber 44. The bite valve member 42 defines a bite valve opening 48 that is normally closed when the bite valve member 42 un-deformed. Deforming the bite valve member 42 by, for example, biting on this member 42, allows liquids within the valve chamber 44 to be withdrawn through the valve outlet opening 48.

The heating system 26 comprises a controller 50, a battery pack 52, control wires 54, a control switch 56, and a heating element assembly 58. The control wires 54 extend through the insulation member 46 outside of the hose 40 as perhaps best shown in FIG. 2.

The heating element assembly 58 comprises first and second lead wires 60 and 62, first and second terminal assemblies 64 and 66, and a heating element 70. The example heating element 70 is an elongate wire that, as arranged to form the heating system 26, defines first and second end portions 72 and 74 and a loop portion 76. The example heating system 26 comprises an element jacket 78 formed over the example heating element 70. The first and second terminal assemblies 64 and 66 extend through a rear panel 80 of the bladder 30, and each of the example first and second screw assembly comprises a screw 82, a nut 84, and a washer 86. The terminal assemblies 64 and 66 form first and second conductive paths from the exterior of the bladder chamber 32 to the interior of the bladder chamber 32. These terminal assemblies 64 and 66 further seal the openings in the rear panel 80 through which the screws 82 extend.

The first and second lead wires 60 and 62 are operatively connected to the first and second terminal assemblies 64 and 66 outside of the bladder chamber 32. The first and second end portions 72 and 74 of the heating element 70 are connected to the first and second terminal assemblies 64 and 66 within the bladder chamber 32. The controller 50 is thus connected to the heating element 70 through the first and second lead wires 60 and 62 and the first and second terminal assemblies 64 and 66.

An electrical circuit is formed that allows current to flow from the controller 50 and through the element heating wire 70. The control wires 54 and control switch 56 places the controller 50 in either an "OFF" configuration, in which current is prevented from flowing through the element heating wire 70, or in an "ON" configuration, in which the current is allowed to flow through the element heating wire 70.

Figure 2:
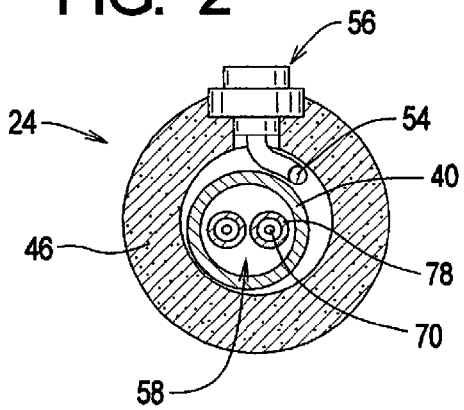
FIG. 2 is a section view taken along lines 2-2 in FIG. 1.
Figure 3:
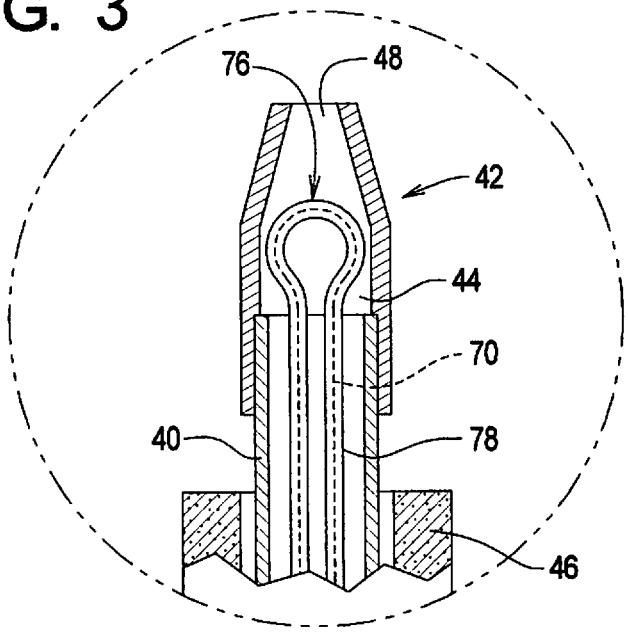
FIG. 3 is a detail view of the area identified by broken lines 3-3 in FIG. 1.
Figure 4:
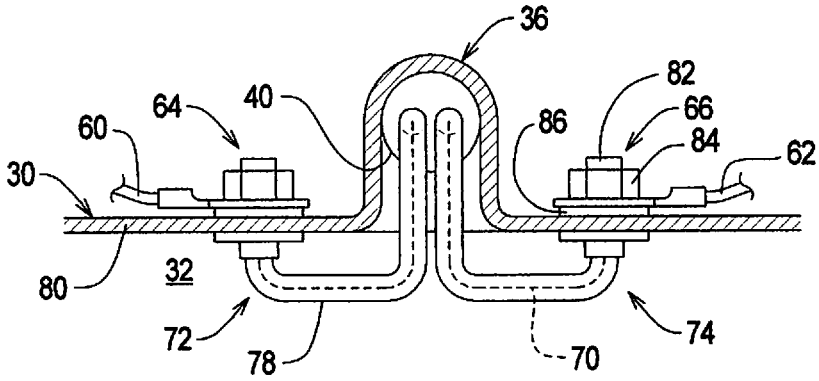
FIG. 4 is a section view taken along lines 4-4 in FIG. 1.
Figure 5:
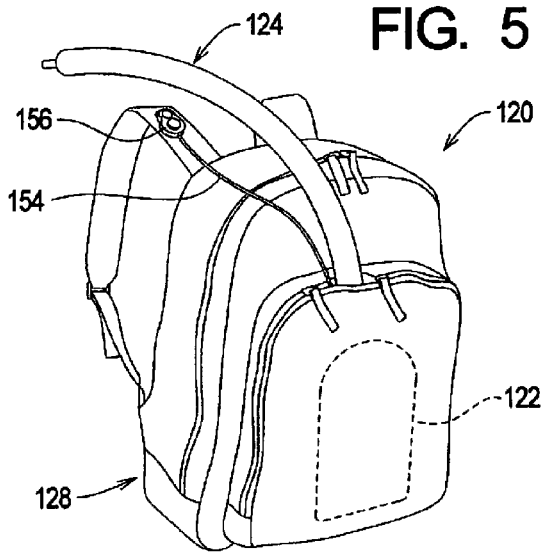
FIG. 5 is a perspective view of a hydration system employing a second example heating system of the present invention.
Figure 6:
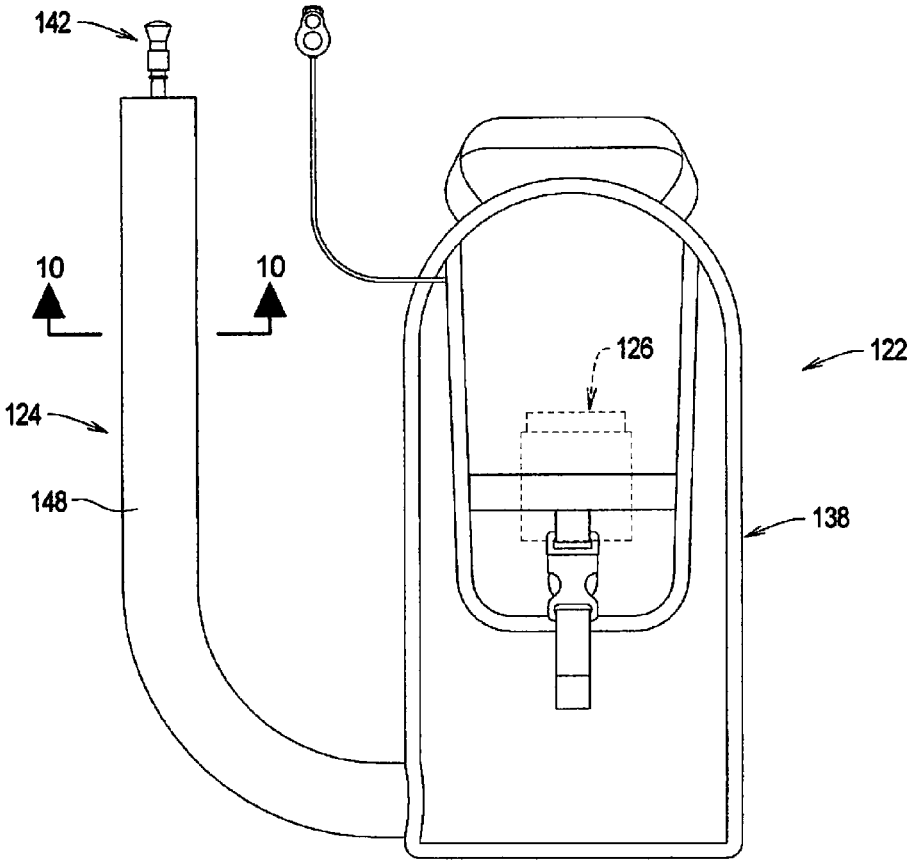
FIG. 6 is a somewhat schematic rear elevation view of the bladder assembly of the hydration system of FIG. 5.
Figure 7:
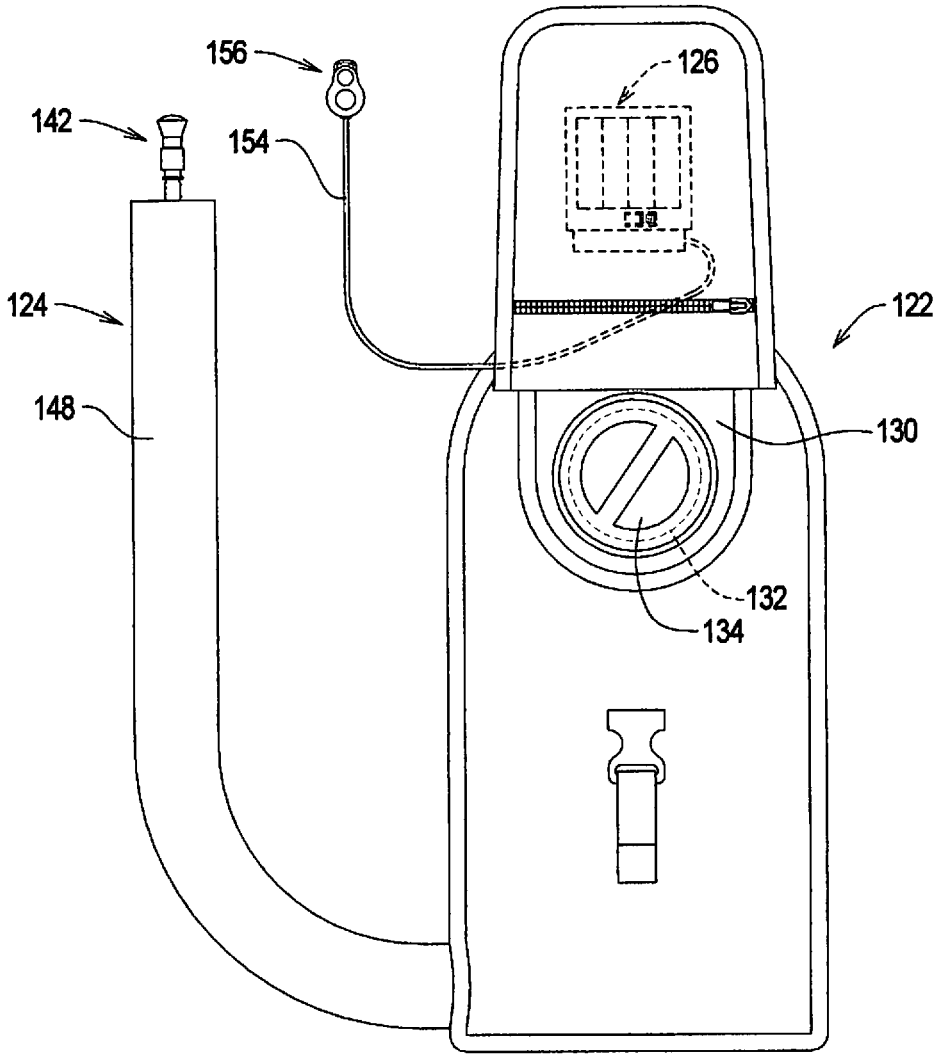
FIG. 7 is a rear view similar to FIG. 6 depicting a bladder inlet of the bladder assembly.
Figure 8:
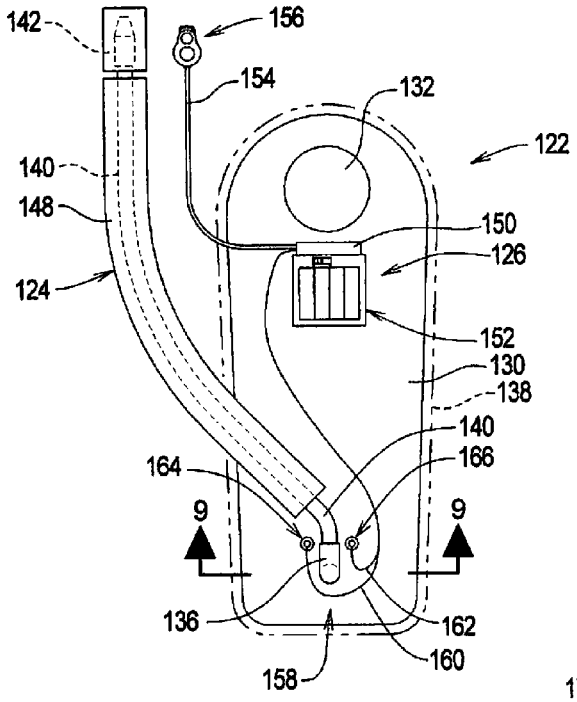
FIG. 8 is a highly schematic view depicting the active components of the bladder assembly of FIG. 6.
Figure 10:
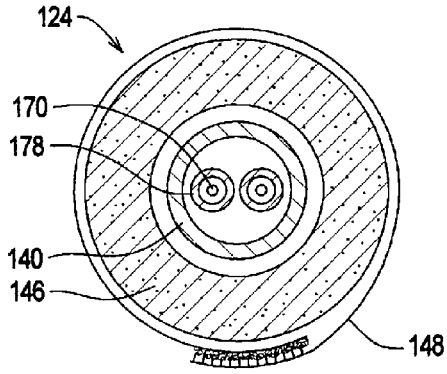
FIG. 10 is a section view taken along lines 10-10 in FIG. 6.

As perhaps best shown in FIGS. 2, 3, and 4, the first and second end portions 72 and 74 of the heating element 70 are arranged within the bladder chamber 32 and extends through the hose 40 such that the loop portion 76 is arranged within the valve chamber 44. While the example heating element 70 is sized and dimensioned such that the loop portion 76 thereof is arranged within the valve chamber 44, many of the benefits of the present invention may be obtained so long as the loop portion extends through at least a part of the hose 40 such that freezing of liquids in the remaining part of the hose 40 and/or within the valve chamber 44 is inhibited.

The heating element 70 is a resistive component that heats up when current flows therethrough. Accordingly, when the controller 50 is in the "ON" configuration, heat radiates from the heating element 70 into the space surrounding the heating element 70 and, in particular, to the interior of the hose 40 and the valve chamber 44. The heat radiating from the heating element 70 is, under most conditions, sufficient to prevent freezing of any fluid within the interior of the hose 40 and in the valve chamber 44.

The bladder assembly 22 and hose assembly 24 may be conventional and will not be described herein in further detail. The heating system 26 may be made of any components and materials capable of causing heat to radiate into the interior of the hose 40 and the valve chamber 44 as generally described above. The Applicant has used nichrome wire as the heating element 70, and the element jacket 78 is Teflon material placed or wrapped over the heating element 70 to form a barrier layer. The combination of the heating element 70 and the element jacket 78 forms a compact structure that does not interfere with the flow of fluid from the bladder chamber 32 to the valve chamber 44 through the hose 40. The heating element 70 and element jacket 78 also do not interfere with normal operation of the bite valve 42. The example element jacket 78 prevents the heating element 70 from coming into contact with the liquids within the bladder chamber 32, the interior of the hose 40, and the valve chamber 44. The example element jacket 78 further is an insulator that prevents shorting of the example heating element 70.

Referring now to FIGS. 5-13 of the drawing, depicted therein is a second example hydration system 120 constructed in accordance with, and embodying, the principles of the present invention. The second example hydration system 120 comprises a bladder assembly 122, a hose assembly 124, a heating system 126, and a carrying assembly 128.

In general, the bladder assembly 122 contains water or other drinkable liquids, and the hose assembly 124 allows a user to drink liquids from the bladder assembly in a conventional manner. The example heating system 126 is arranged to extend through and heat the hose assembly 124 to prevent freezing of liquids contained by the hose assembly 124 without interfering with the user's ability to drink fluids from the bladder assembly 122 through the hose assembly 124. The carrying assembly 128 is optional and facilitates carrying or wearing of the bladder assembly 122, hose assembly 124, and/or heating system 126.

The second example bladder assembly 122 comprises a bladder 130 defining a bladder chamber 132, a bladder cap 134, a bladder outlet 136, and a bladder bag 138. The bladder cap 134 may be detachably attached to the bladder 130 to prevent or allow access to the bladder chamber 132 in a conventional manner.

The hose assembly 124 comprises a hose member 140, a bite valve assembly 142 defining a valve chamber 144, an insulation member 146, and a hose jacket 148. The hose member 140 is operatively connected to the bladder outlet 136 and the bite valve assembly 142 such that a fluid path is defined between the bladder chamber 132 and the valve chamber 144. The bite valve assembly 142 allows liquids to be withdrawn from the valve chamber 144 as will be described in further detail below.

The heating system 126 comprises a controller 150, a battery pack 152, control wires 154, a control switch 156, and a heating element assembly 158. The control wires 154 extend from the bladder bag 138 such that the control switch 156 may be arranged anywhere on the carrying assembly 128 convenient for the user/wearer.

The heating element assembly 158 comprises first and second lead wires 160 and 162, first and second terminal assemblies 164 and 166, and a heating element 170. The example heating element 170 is an elongate wire that, as arranged to form the heating system 126, defines first and second end portions 172 and 174 and a loop portion 176. The example heating system 126 comprises an element jacket 178 formed over the example heating element 170.

The first and second terminal assemblies 164 and 166 extend through a rear panel 180 of the bladder 130, and each of the example first and second screw assembly comprises a screw 182, an interior nut 184, a first exterior nut 186, and a second exterior nut 188. The terminal assemblies 164 and 166 form first and second conductive paths from the exterior of the bladder chamber 132 to the interior of the bladder chamber 132. These terminal assemblies 164 and 166 further seal the openings in the rear panel 180 through which the screws 182 extend.

The first and second lead wires 160 and 162 are operatively connected to the first and second terminal assemblies 164 and 166 outside of the bladder chamber 132. The first and second end portions 172 and 174 of the heating element 170 are connected to the first and second terminal assemblies 164 and 166 within the bladder chamber 132. The controller 150 is thus connected to the heating element 170 through the first and second lead wires 160 and 162 and the first and second terminal assemblies 164 and 166.

An electrical circuit is formed that allows current to flow from the controller 150 and through the element heating wire 170. The control wires 154 and control switch 156 places the controller 150 in either an "OFF" configuration, in which current is prevented from flowing through the element heating wire 170, or in an "ON" configuration, in which the current is allowed to flow through the element heating wire 170.

Figure 9:
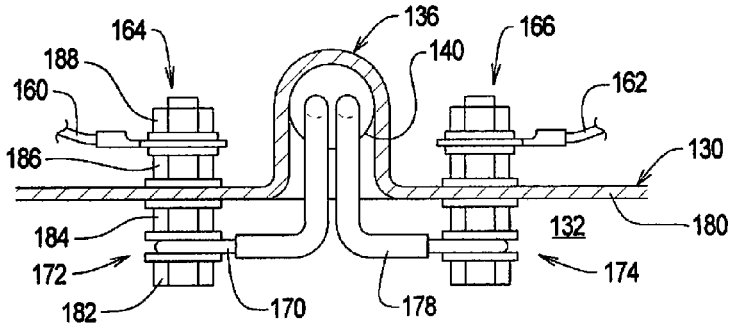
FIG. 9 is a section view taken along lines 9-9 in FIG. 8.

As perhaps best shown in FIG. 9, the first and second end portions 172 and 174 of the heating element 170 are arranged within the bladder chamber 132 and extends through the hose 140 such that the loop portion 176 is arranged within the valve chamber 144. While the example heating element 170 is sized and dimensioned such that the loop portion 176 thereof is arranged within the valve chamber 144, many of the benefits of the present invention may be obtained so long as the loop portion extends through at least a part of the hose 140 such that freezing of liquids in the remaining part of the hose 140 and/or within the valve chamber 144 is inhibited.

The heating element 170 is a resistive component that heats up when current flows therethrough. Accordingly, when the controller 150 is in the "ON" configuration, heat radiates from the heating element 170 into the space surrounding the heating element 170 and, in particular, to the interior of the hose 140 and the valve chamber 144. The heat radiating from the heating element 170 is, under most conditions, sufficient to prevent freezing of any fluid within the interior of the hose 140 and in the valve chamber 144.

The bladder assembly 122 and hose assembly 124 may be conventional and will not be described herein in further detail. The heating system 126 may be made of any components and materials capable of causing heat to radiate into the interior of the hose 140 and the valve chamber 144 as generally described above. The Applicant has used nichrome wire as the heating element 170, and the element jacket 178 is Teflon material placed or wrapped over the heating element 170 to form a barrier layer. The combination of the heating element 170 and the element jacket 178 forms a compact structure that does not interfere with the flow of fluid from the bladder chamber 132 to the valve chamber 144 through the hose 140. The heating element 170 and element jacket 178 also do not interfere with normal operation of the bite valve assembly 142. The example element jacket 178 prevents the heating element 170 from coming into contact with the liquids within the bladder chamber 132, the interior of the hose 140, and the valve chamber 144. The example element jacket 178 further is an insulator that prevents shorting of the example heating element 170.

Figure 11:
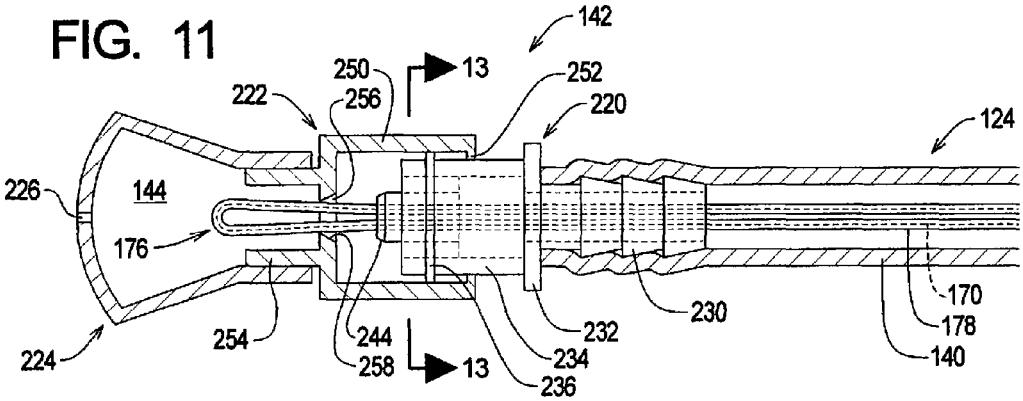
FIGS. 11 and 12 are section views of a bite vale assembly in disabled (FIG. 11) and enabled (FIG. 12) configurations.
Figure 12:
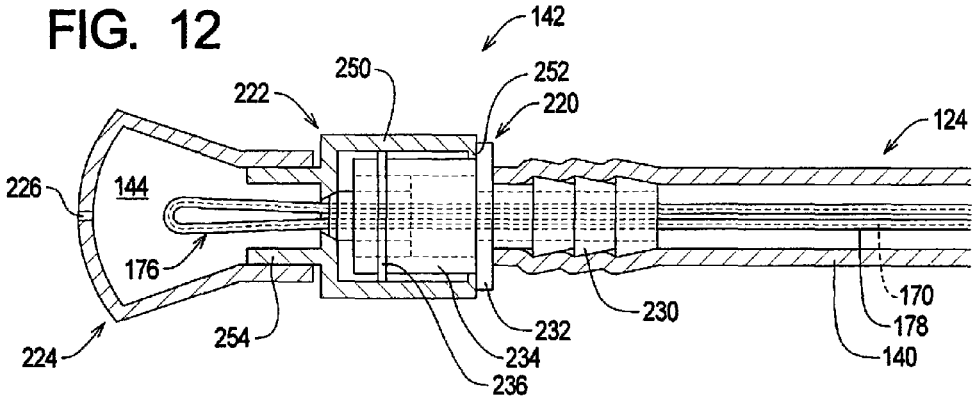
Figure 13:
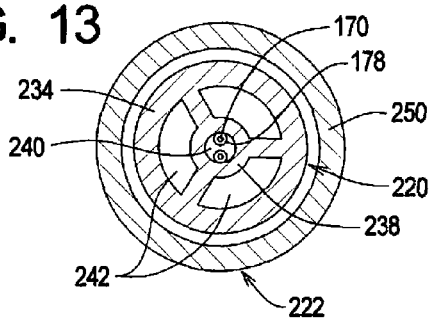
FIG. 13 is a section view taken along lines 13-13 in FIG. 11.

Referring now to FIGS. 11-13, the construction and operation of the example bite valve assembly 142 will now be described in further detail. The bite example valve assembly 142 comprises a base member 220, a collar member 222, a bite valve member 224. The bite valve member 224 defines a valve outlet opening 226. The bite valve outlet opening 226 is normally closed when the bite valve member 224 is undeformed. Deforming the bite valve member 224 by, for example, biting on this member 224, allows liquids within the valve chamber 144 to be withdrawn through the valve outlet opening 226.

The base member 220 defines an engaging portion 230, a center flange portion 232, a shaft portion 234, a guide flange portion 236, and a wire support portion 238. The wire support portion 238 defines a wire passageway 240, a fluid passageway 242, and a first valve surface 244. The collar member 222 defines a housing portion 250, a housing flange portion 252, a mounting projection 254, a shut-off valve passageway 256, and a second valve surface 258. The engaging portion 230 of the base member 220 engages the hose 140. The mounting projection 254 engages and supports the bite valve member 224.

Accordingly, in addition to the open and closed configurations defined by the bite valve member 224, the base member 220 and the collar member 222 cooperated to define a disabled configuration (FIG. 12) and an enabled configuration (FIG. 11). In particular, the shaft portion 234 of the base member 220 supports the collar member 222 for movement between a first position (FIG. 12) and a second position (FIG. 11). The guide flange portion 236 and housing flange portion 252 ensure relatively aligned coaxial movement of the collar member 222 relative to the base member 220. The engagement of the housing flange portion 252 and the center flange portion 232 defines the first position, while the engagement of the housing flange portion 252 with the guide flange portion 236 defines the second position.

When the collar member 222 is in the first position, the first valve surface 244 engages the second valve surface 258 to prevent fluid flow through the shut-off valve passageway 256. When the collar member 222 is in the second position, the first valve surface 244 is disengaged from the second valve surface 258 to allow fluid to flow through the shut-off valve passageway 256.

As shown in FIG. 13, the wire support portion 238 supports the heating element 170 such that the heating element 170 extends through the shut-off valve passageway 258 and the loop portion 176 of the heating element 170 lies within the valve chamber 144.

The present invention may be embodied in forms other than those described above. The scope of the present invention should thus be determined by the claims appended hereto and not the foregoing detailed description of example embodiments of the invention.

What is claimed is:

1. A portable hydration system, comprising:

a bladder assembly comprising a bladder chamber configured to hold a drinkable fluid;

a hose assembly operably connected to the bladder assembly; and a heating system comprising at least one battery, a control switch operable by a user, and a heating element having at least a portion thereof configured in a loop, the heating system being configured to permit electrical current provided by the at least one battery to flow through the heating element and heat same when the control switch is actuated by the user into an "on" position;

wherein the hose assembly further comprises a flexible hose member having an interior volume extending between proximal and distal ends thereof, the proximal end being operably connected to the bladder chamber, the distal end being operably connected to a bite valve comprising a valve chamber, the hydration system being configured to permit the user to withdraw fluid from the bladder chamber by sucking the fluid through the flexible hose member and the bite valve when at least portions of fluid disposed within the interior volume or the valve chamber are not frozen, and further wherein at least portions of the heating element are disposed within at least portions of the interior volume of the flexible hose member, and at least portions of the loop of the heating element are disposed within at least portions of the valve chamber, the hydration system further being configured to permit frozen fluid contained within at least portions of the interior volume or the valve chamber to be thawed by actuating the control switch into the "on" position and thereby causing electrical current to flow through, and cause heating of, the heating element.

2. The portable hydration system of claim 1, wherein the heating system further comprises first and second terminal assemblies.

3. The portable hydration system of claim 2, wherein a first portion of the first and second terminal assemblies is disposed outside the bladder chamber, a second portion of the first and second terminal assemblies is disposed inside the bladder chamber, and first and second end portions of the heating element are operatively connected to the first and second terminal assemblies, respectively.

4. The portable hydration system of claim 1, wherein the heating system further comprises a controller operatively connected to the heating element and the control switch, the controller being configured to selectively cause electrical current to flow through the heating element when the control switch is actuated by the user into the "on" position.

5. The portable hydration system of claim 1, wherein the bite valve further comprises an assembly comprising a base member, a collar member, the bite valve, and the valve chamber.

6. The portable hydration system of claim 1, wherein the collar member is configured to support the bite valve and the base member is configured to support the collar member for movement between first and second positions.

7. The portable hydration system of claim 6, wherein in the first position the fluid is substantially prevented from flowing from the bladder chamber to the valve chamber, and in the second position the fluid is permitted to flow from the bladder chamber to the valve chamber.

8. The portable hydration system of claim 1, wherein the bladder assembly further comprises at least one of a bladder cap and a bladder outlet.

9. The portable hydration system of claim 1, wherein the hose assembly further comprises an insulation member.

10. The portable hydration system of claim 1, wherein the bite valve is normally closed when undeformed by the user.

11. The portable hydration system of claim 1, wherein the at least one battery of the heating system further comprises a plurality of batteries.

12. The portable hydration system of claim 11, wherein the plurality of batteries are arranged in a battery pack.

13. The portable hydration system of claim 1, wherein the heating element further comprises an element jacket disposed over at least portions thereof.

14. The portable hydration system of claim 13, wherein the element jacket comprises polytetrafluoroethylene.

15. The portable hydration system of claim 1, wherein the heating element further comprises at least one elongate wire.

16. The portable hydration system of claim 1, wherein the heating element further comprises a resistive heating component.

17. The portable hydration system of claim 1, wherein the heating element further comprises nichrome wire.

18. The portable hydration system of claim 1, further comprising a carrying assembly.

19. The portable hydration system of claim 1, further comprising a wire support portion configured to support and hold the heating element within the valve chamber in a desired position.

20. A method of thawing at least portions of a frozen drinkable fluid disposed in a flexible hose member or a bite valve in a portable hydration system, the portable hydration system comprising a bladder assembly comprising a bladder chamber configured to hold a drinkable fluid, a hose assembly operably connected to the bladder assembly, and a heating system comprising at least one battery, a control switch operable by a user, and a heating element having at least a portion thereof configured in a loop, the heating system being configured to permit electrical current provided by the at least one battery to flow through the heating element and heat same when the control switch is actuated by the user into an "on" position, wherein the hose assembly further comprises a flexible hose member having an interior volume extending between proximal and distal ends thereof, the proximal end being operably connected to the bladder chamber, the distal end being operably connected to a bite valve comprising a valve chamber, the hydration system being configured to permit the user to withdraw fluid from the bladder chamber by sucking the fluid through the flexible hose member and the be valve when at least portions of fluid disposed within the interior volume or the valve chamber are not frozen, and further wherein at least portions of the heating element are disposed within at least portions of the interior volume of the flexible hose member, and at least portions of the loop of the heating element are disposed within at least portions of the valve chamber, the hydration system further being configured to permit frozen fluid contained within at least portions of the interior volume or the valve chamber to be thawed by actuating the control switch into the on position and thereby causing electrical current to flow through, and cause heating of, the heating element, the method comprising:

actuating the control switch into the on position and thereby causing thawing of at least portions of the frozen fluid disposed in the interior volume or the bite valve.

* * * * *